US009435620B2

(12) United States Patent
Hamazaki et al.

(10) Patent No.: US 9,435,620 B2
(45) Date of Patent: Sep. 6, 2016

(54) FLIGHT UNIT AND DART

(71) Applicant: HAMADA KOUSYOU CO., LTD., Aichi (JP)

(72) Inventors: Yukio Hamazaki, Aichi (JP); Katsuo Iguchi, Aichi (JP)

(73) Assignee: HAMADA KOUSYOU CO., LTD., Aichi (JP)

( * ) Notice: Subject to any disclaimer, the term of this patent is extended or adjusted under 35 U.S.C. 154(b) by 0 days.

(21) Appl. No.: 14/616,475

(22) Filed: Feb. 6, 2015

(65) Prior Publication Data

US 2016/0231092 A1 Aug. 11, 2016

(51) Int. Cl.
*F42B 6/00* (2006.01)

(52) U.S. Cl.
CPC ..... *F42B 6/003* (2013.01)

(58) Field of Classification Search
CPC ..... F42B 6/003; F42B 6/06
See application file for complete search history.

(56) References Cited

U.S. PATENT DOCUMENTS 3,995,861 A 12/1976 Clarke
4,978,130 A * 12/1990 Farler ..... F42B 6/003 473/586
5,642,887 A * 7/1997 Orav ..... F42B 6/003 473/586
8,177,668 B2 * 5/2012 Matsubara ..... F42B 6/003 473/578

FOREIGN PATENT DOCUMENTS

JP 2010-063582 A 3/2010
JP 2011-110413 A 6/2011
JP 5475911 B 4/2014
JP 2014-239834 A 12/2014

OTHER PUBLICATIONS

Office Action issued in JP Application 2013-124068, Oct. 17, 2013 with machine English translation.

* cited by examiner

*Primary Examiner* — John Ricci
(74) *Attorney, Agent, or Firm* — Hedman & Costigan, P.C.; James V. Costigan; Kathleen A. Costigan

(57) ABSTRACT

A flight unit in which a flight is connected to a shaft rotatably and without possible wobbling and a dart comprising the flight unit are provided.
The flight unit 2 is a part of a dart comprising a shaft 30 and a flight 40. The shaft 30 comprises a shaft body 31, a protrusion 32 provided at one end of the shaft body 31, and a flight connector 34 provided at the tip of the protrusion 32. The flight 40 comprises a hollow cylinder 42 in which the protrusion 32 is slidably fitted, vines 41 at the bases of which the hollow cylinder 42 is provided, and an open cavity 43 adjoining the hollow cylinder 42 and in which the flight connector 34 is slidably fitted. The open cavity 43 is provided to the vines 41 and comprises no exterior walls.

5 Claims, 13 Drawing Sheets

FLIGHT UNIT AND DART

FIELD

This application relates generally to a flight unit and a dart.

BACKGROUND

The game of darts is a game in which one throws a dart (arrow) at a dart board (target) fixed on the wall or the like and competes for higher scores.

Generally, a dart comprises a point that makes contact with the target, a barrel functioning as a hold, a flight comprising vines, and a shaft to which the flight is connected. In this specification, the part of a dart corresponding to the connected flight and shaft is called a flight unit.

Patent Literature 1 and 2 each disclose a flight unit in which the flight is rotatably connected to the shaft and a dart comprising the flight unit.

Patent Literature 1: Unexamined Japanese Patent Application Kokai Publication No. 2010-63582; and Patent Literature 2: Unexamined Japanese Patent Application Kokai Publication No. 2011-110413.

The darts comprising the flight units of the Patent Literature 1 and 2 have a drawback that when one holds the dart to throw, the flight connected to the shaft wobbles, which makes the throwing difficult.

The present disclosure is made with the view of the above circumstance and an objective of the present disclosure is to provide a flight unit in which the flight is connected to the shaft rotatably and without possible wobbling and a dart comprising the flight unit.

SUMMARY

In order to achieve the above objective, the flight unit of the present disclosure is a flight unit that is a part of a dart comprising a shaft and a flight, wherein the shaft comprises a shaft body, a protrusion provided at one end of the shaft body, and a flight connector provided at the tip of the protrusion, the flight comprises a hollow cylinder in which the protrusion is slidably fitted, vines at the bases of which the hollow cylinder is provided, and an open cavity adjoining the hollow cylinder and in which the flight connector is slidably fitted, the open cavity is provided to the vines and comprises no exterior walls, and the hollow cylinder is provided rotatably with respect to the protrusion of the shaft.

Preferably, the flight unit is characterized in that:

a first step is provided at the border between the shaft body and the protrusion and a second step is provided at the border between the protrusion and the flight connector.

Preferably, the flight unit is characterized in that:

the plane in which the first step lies and the plane in which the second step lies are parallel to each other and/or both perpendicular to the axis of the shaft.

Preferably, the flight unit is characterized in that:

a projection projecting in the axis direction of the shaft is formed on one of the shaft and the flight, and a recess in which the projection is fitted is formed in the other of the shaft and the flight.

Preferably, the flight unit is characterized in that:

the protrusion is catenoidal in the axis direction.

The dart of the present disclosure comprises:

the above-described flight unit;

a barrel functioning as a hold; and a point that makes contact with the target.

The present disclosure can provide a flight unit in which the flight is connected to the shaft rotatably and without possible wobbling and a dart comprising the flight unit.

BRIEF DESCRIPTION OF THE DRAWINGS

A more complete understanding of this application can be obtained when the following detailed description is considered in conjunction with the following drawings, in which:

FIG. 6A, an overall view; FIG. 6B, a partially cross-sectional view; FIG. 6C, a front view in the direction A; and FIG. 6D, a front view in the direction B;

FIG. 7A, an overall view; FIG. 7B, an exploded view; FIG. 7C, a partially cross-sectional view; and FIG. 7D, a front view in the direction A;

FIG. 8A, an overall view; FIG. 8B, an exploded view; FIG. 8C, a partially cross-sectional view; and FIG. 8D, a partial enlarged view of the cross-sectional view shown in FIG. 8C; FIG. 9A, an exploded view; FIG. 9B, an exploded, perspective view; and FIG. 9C, a partially cross-sectional view.

DETAILED DESCRIPTION

Embodiment 1

Figure 1:
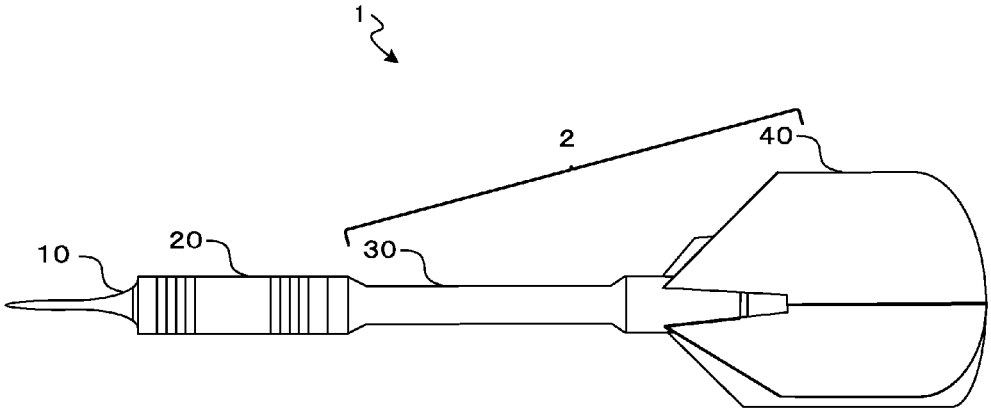
FIG. 1 is an overall view of the dart according to Embodiment 1.
Figure 2:
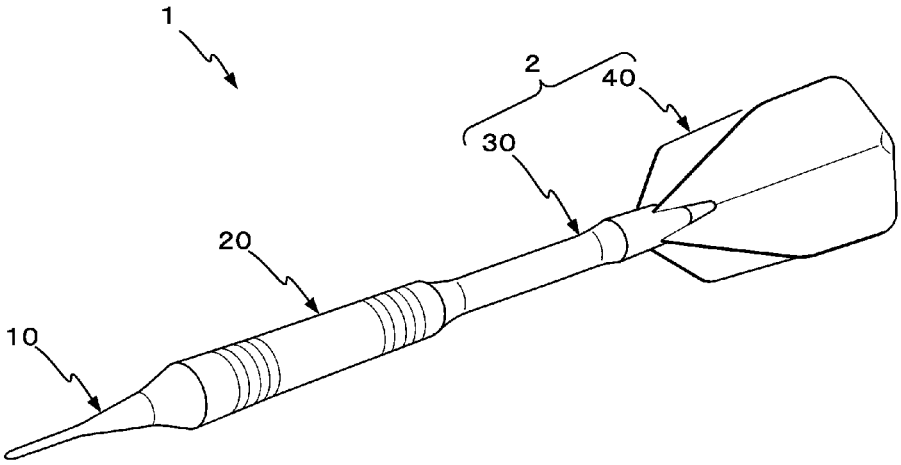
FIG. 2 is an overall, perspective view of the dart according to Embodiment 1.

The flight unit and dart according to Embodiment 1 of the present disclosure will be described in detail hereafter with reference to the drawings. As shown in FIGS. 1 and 2, a dart 1 comprises a point 10, a barrel 20, a shaft 30, and a flight 40. As shown in FIGS. 1 to 4, a flight unit 2 comprises the shaft 30 and flight 40.

Figure 3:
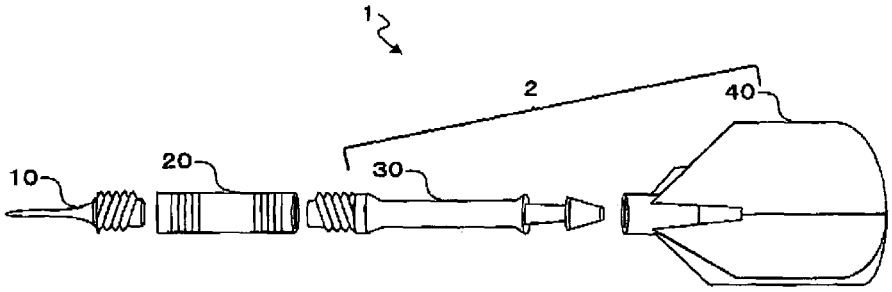
FIG. 3 is an exploded view of the dart according to Embodiment 1.
Figure 4:
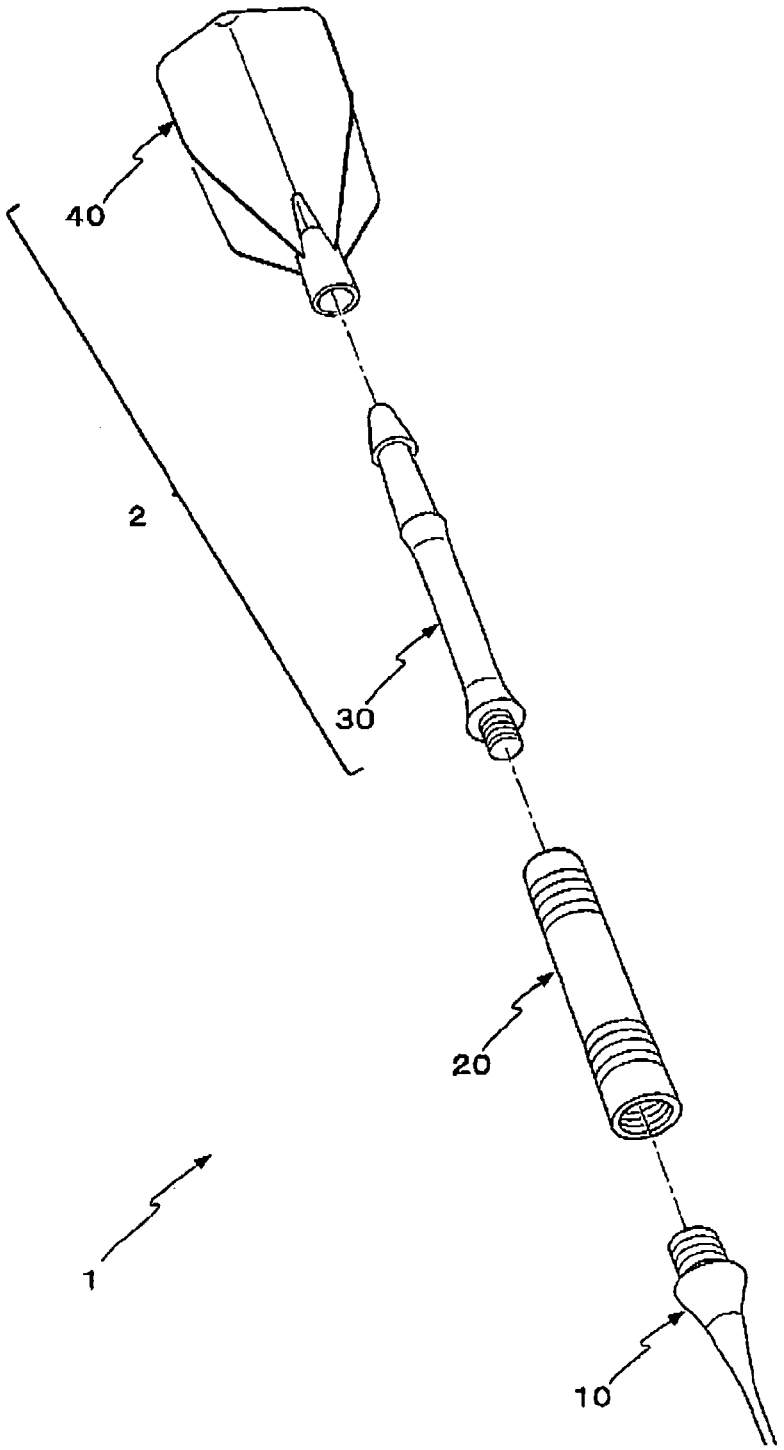
FIG. 4 is an exploded, perspective view of the dart according to Embodiment 1.

The point 10 is the leading end of the dart 1 and makes contact with the target when the dart 1 is thrown at the target. The point 10 has an external screw thread at one end as shown in FIGS. 3 and 4. This external screw thread is screwed in the internal screw thread provided at one end of the barrel 20 described later to connect the point 10 to the barrel 20. The material of the point 10 is a metal, synthetic resin, or the like.

The barrel 20 serves as the hold of the dart 1 when the user throws the dart 1 at the target. The barrel 20 has non-slip grooves incised as shown in FIGS. 3 and 4. The barrel 20 has an internal screw thread (not shown) at one end, which is screwed on the external screw thread provided at one end of the point 10. The barrel 20 has an internal screw thread (not shown) at the other end as well, which is screwed on the external screw thread provided at one end of the shaft 30 described later. The material of the barrel 20 is a metal, synthetic resin, or the like.

Figure 5:
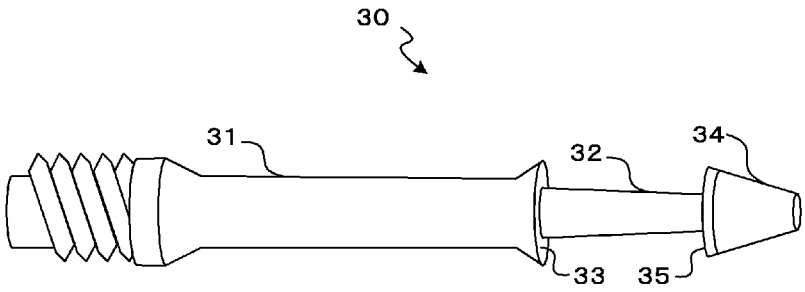
FIG. 5 is an overall view of the shaft according to Embodiment 1.

The flight 40 described later is connected to the shaft 30. The shaft 30 forms the flight unit 2 together with the flight 40. The shaft 30 comprises, as shown in FIG. 5, a shaft body 31, a protrusion 32, a first step 33, a flight connector 34, and a second step 35.

The material of the shaft body 31 is a metal, synthetic resin, glass fiber, or the like. The shaft body 31 has an external screw thread at one end as shown in FIG. 5. This external screw thread is screwed in the internal screw thread provided at one end of the barrel 20 to connect the shaft 30 to the barrel 20.

The protrusion 32 is provided at the end of the shaft body 31 where the external screw thread is not provided. The protrusion 32 has a cylindrical or truncated cone shape and slidably fitted in the hollow cylinder 42 of the flight 40 described later.

The first step 33 is provided at the border between the shaft body 31 and protrusion 32. Since the protrusion 32 has a cylindrical or truncated cone shape, the protrusion 32 has a circular cross-section perpendicular to the axis of the shaft 30 at the border between the protrusion 32 and shaft body 31. The area of this circular cross-section is smaller than the area of the one end of the shaft body 31 where the protrusion 32 is provided, whereby the first step 33 is formed as shown in FIG. 5.

The flight connector 34 is provided at the tip of the protrusion 32. The flight connector 34 is so shaped as to be slidably fitted in the open cavity 43 of the flight 40 described later.

The second step 35 is provided at the border between the protrusion 32 and flight connector 34. Since the protrusion 32 has a cylindrical or truncated cone shape, the protrusion 32 has a circular cross-section perpendicular to the axis of the shaft 30 at the border between the protrusion 32 and flight connector 34. The area of this circular cross-section is smaller than the area of the end of the flight connector 34 that abuts on the protrusion 32, whereby the second step 35 is formed as shown in FIG. 5.

As shown in FIG. 5, the plane in which the first step 33 lies and the plane in which the second step 35 lies are both perpendicular to the axis of the shaft 30 and parallel to each other.

Figure 6A:
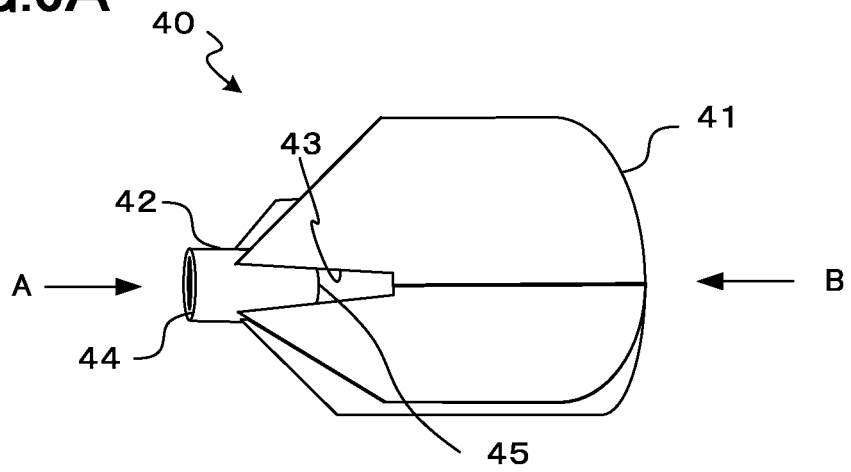
FIGS. 6A to 6D are illustrations showing the structure of the flight according to Embodiment 1.

The flight 40 stabilizes the flight of the dart 1 when the dart 1 is thrown at the target. The flight 40 is connected to the shaft 30. The flight 40 and shaft 30 form the flight unit 2. The flight 40 comprises, as shown in FIG. 6A, vines 41, a hollow cylinder 42, and an open cavity 43.

Figure 6B:
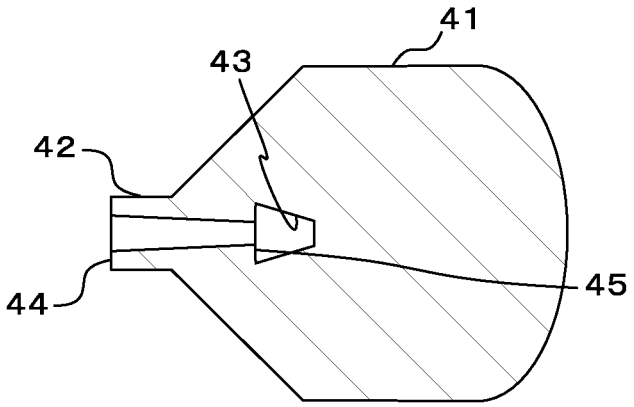
Figure 6C:
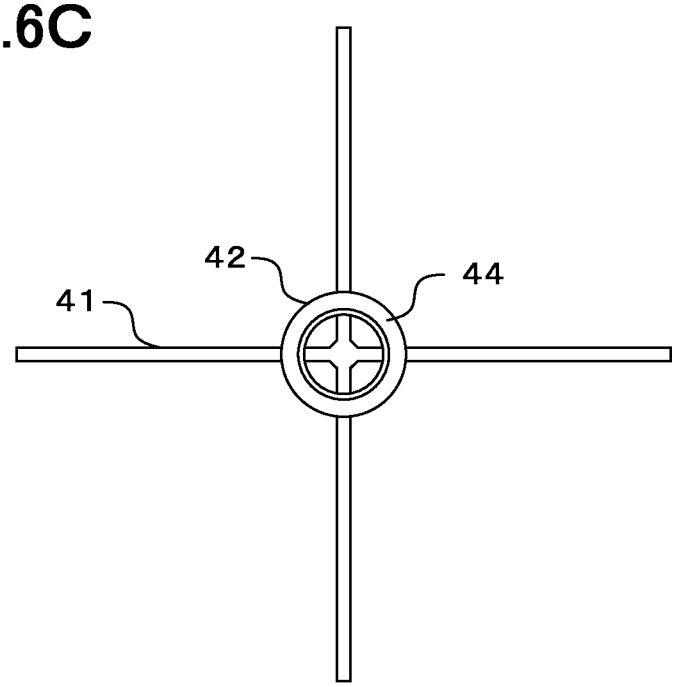
Figure 6D:
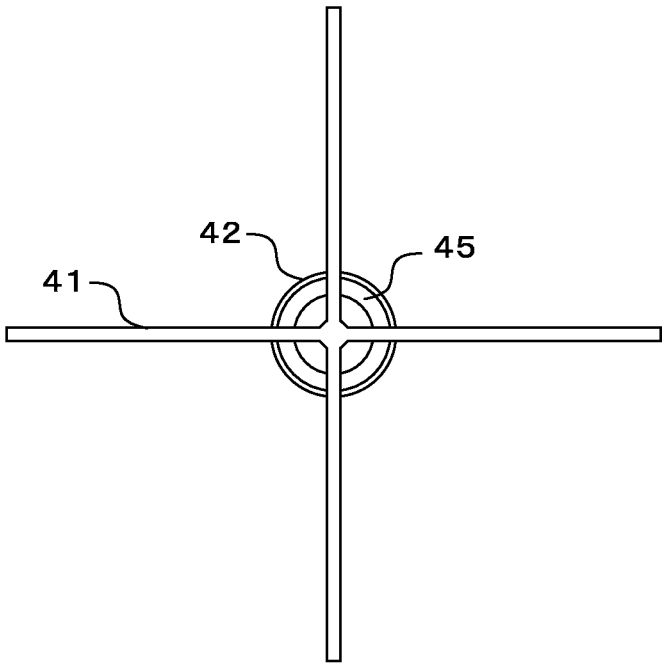

There are four vines 41. The vines 41 are provided at 90-degree intervals around the axis of the hollow cylinder 42 described later as shown in FIGS. 6C and 6D.

The hollow cylinder 42 is provided at the bases of the vines 41, in which the protrusion 32 of the shaft 30 is slidably fitted.

The hollow cylinder 42 is cylindrical in contour and hollow. The hollow inside the hollow cylinder 42 is shaped to allow the protrusion 32 of the shaft 30 to slidably fit in as shown in FIG. 6B. The hollow cylinder 42 has a shaft-side end 44 and a flight-side end 45.

The open cavity 43 adjoins the hollow cylinder 42, in which the flight connector 34 of the shaft 30 is slidably fitted in.

The open cavity 43 is shaped to allow the flight connector 34 of the shaft 30 to slidably fit in.

The material of the flight 40 is a synthetic resin or the like.

The shaft 30 and flight 40 form the flight unit 2 as shown in FIGS. 7A to 7D.

Figure 7A:
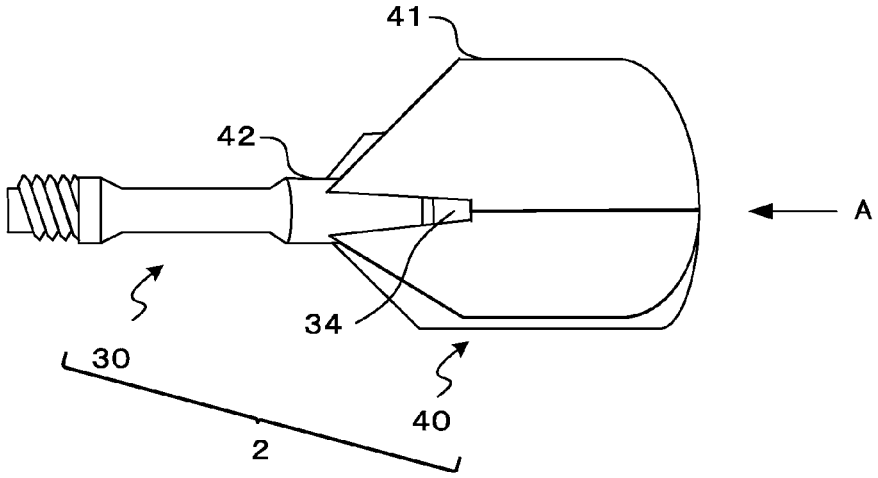
FIGS. 7A to 7D are illustrations showing the structure of the flight unit according to Embodiment 1.
Figure 7B:
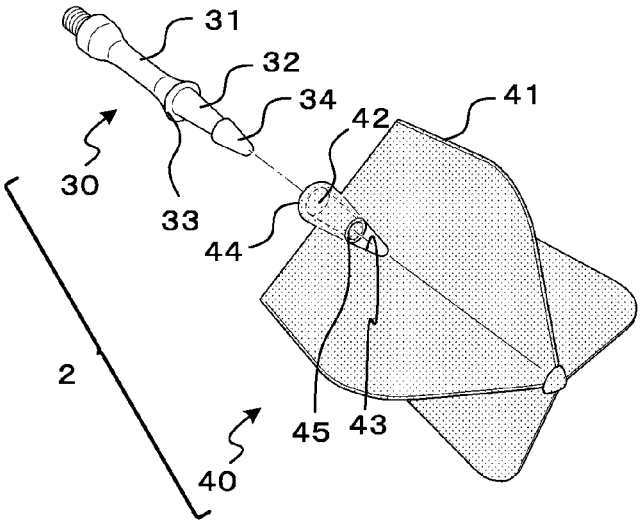
Figure 7C:
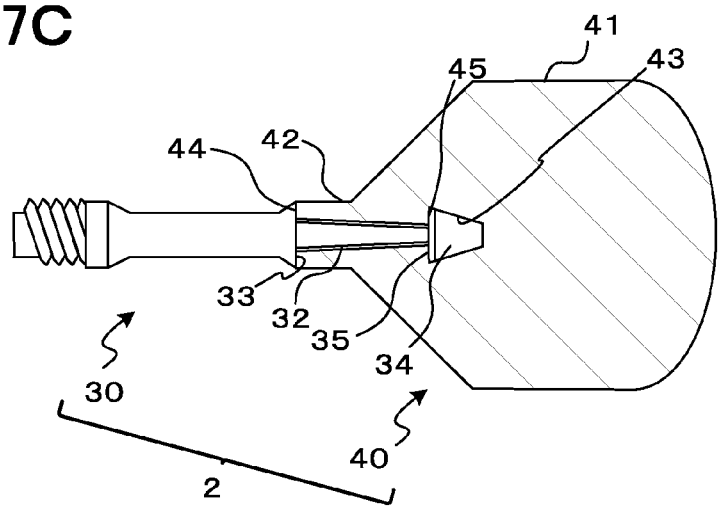
Figure 7D:
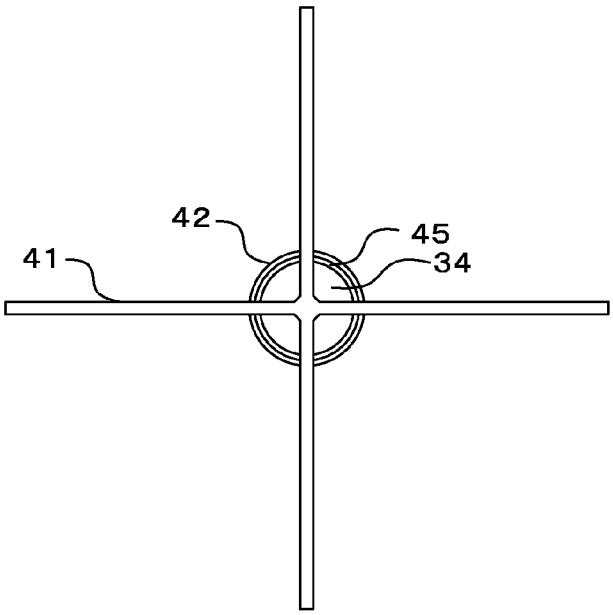

In FIGS. 7A and 7C, the flight connector 34 of the shaft 30 is inserted and locked in the open cavity 43 of the flight 40. In this state, as shown in FIGS. 7A and 7C, the hollow cylinder 42 is slidably fitted on the protrusion 32 and the open cavity 43 is slidably fitted on the flight connector 34. The hollow cylinder 42 slides on the protrusion 32 and the open cavity 43 slides on the flight connector 34, whereby the flight 40 can rotate with respect to the shaft 30.

As shown in FIGS. 7A and 7C, after the flight connector 34 is inserted and locked in the open cavity 43, the hollow cylinder 42 of the flight 40 makes contact with and is locked by the first step 33 and second step 35 of the shaft 30. In other words, as shown in FIGS. 7B and 7C, the first step 33 is in contact with the shaft-side end 44 of the hollow cylinder 42 and the second step 35 is in contact with the flight-side end 45 of the hollow cylinder 42. Consequently, the hollow cylinder 42 is clamped by the first step 33 and second step 35 with such a force that the flight 40 is not prevented from rotating with respect to the shaft 30. Therefore, the flight 40 is connected to the shaft 30 without possible wobbling.

Furthermore, as shown in FIGS. 7A to 7D, the plane in which the first step 33 lies and the plane in which the second step 35 lies are both perpendicular to the axis of the shaft 30 and parallel to each other, whereby the flight 40 rotates stably with respect to the shaft 30.

Incidentally, in this embodiment, the plane in which the first step 33 lies and the plane in which the second step 35 lies are parallel to each other and both perpendicular to the axis of the shaft 30. However, so far as either one of these conditions is satisfied, the flight 40 can rotate stably with respect to the shaft 30.

The flight unit 2 according to this embodiment can connect the flight 40 to the shaft 30 rotatably and without possible wobbling. Therefore, the dart 1 comprising the flight unit 2 according to this embodiment eliminates possible wobbling of the flight 40 upon throwing, and when another dart is thrown and makes contact with the dart 1 stuck on the target, prevents the dart 1 from being damaged by impact from the rotation of the flight 40, whereby the dart 1 does not become an obstacle to the dart thrown later.

Furthermore, the flight unit 2 according to this embodiment allows the flight 40 to rotate stably with respect to the shaft 30.

Embodiment 2

Embodiment 2 of the present disclosure will be described hereafter mainly in regard to the difference from Embodiment 1.

As shown in FIGS. 8A to 8D, the flight unit 2 according to this embodiment is different from the flight unit 2 according to Embodiment 1 shown in FIGS. 7A to 7D in that the shaft 30 has a projection 36 and the flight 40 has a recess 46.

Figure 8A:
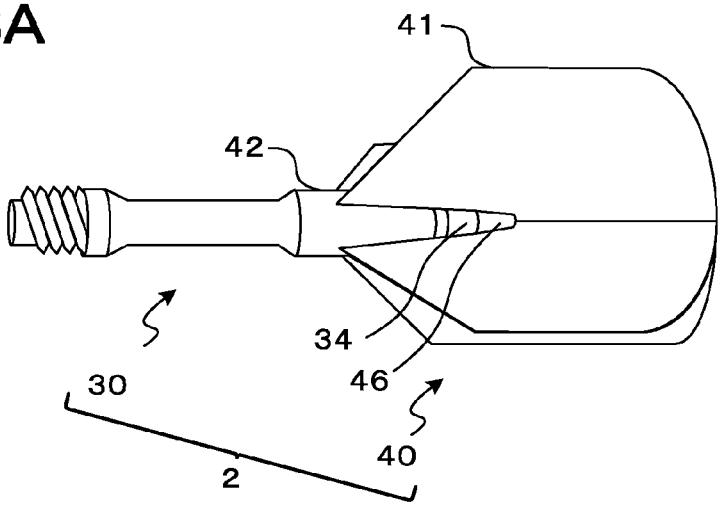
FIGS. 8A to 8D are illustrations showing the structure of the flight unit according to Embodiment 2.
Figure 8B:
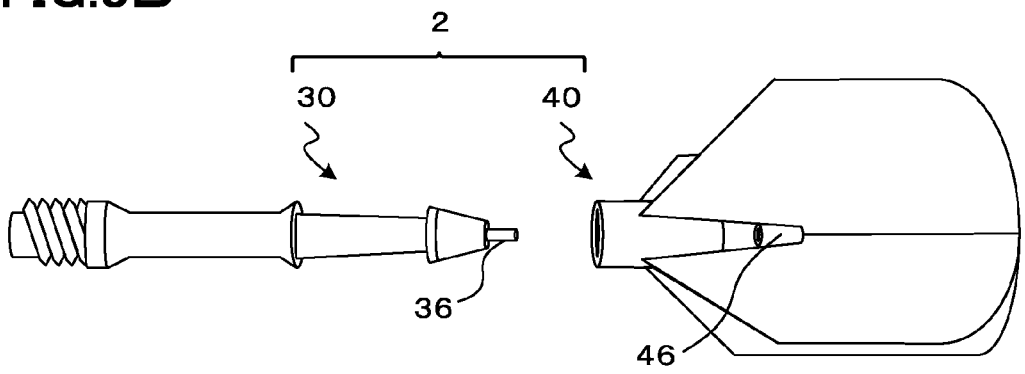
Figure 8C:
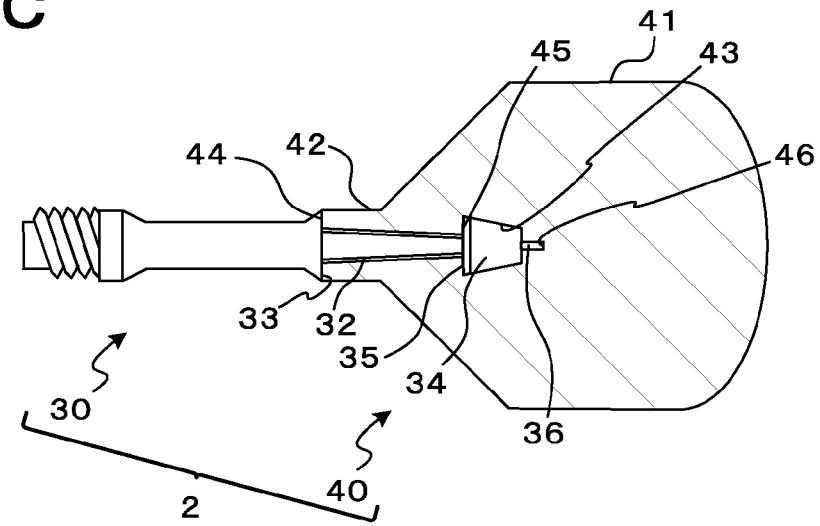

The projection 36 is provided on the flight connector 34 of the shaft 30 as shown in FIGS. 8B and 8C. The projection 36 has a cylindrical or truncated cone shape and projects from the tip of the flight connector 34 in the axis direction of the shaft 30.

The recess 46 is provided at the flight-side end of the open cavity 43 as shown in FIGS. 8A to 8D. The recess 46 is hollow and has a shape for the projection 36 to fit in.

Figure 8D:
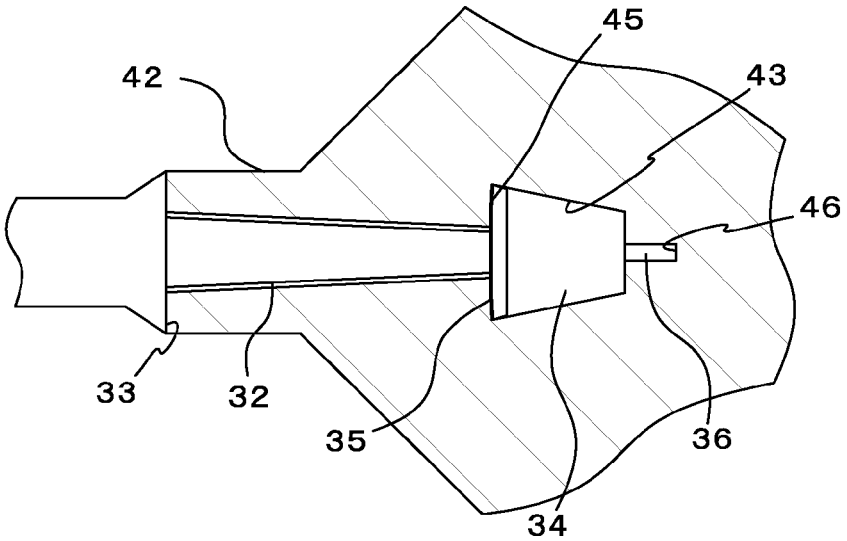

As shown in FIGS. 8A, 8C, and 8D, as the flight connector 34 is inserted and locked in the open cavity 43, the projection 36 is fitted in the recess 46. Consequently, the flight unit 2 according to this embodiment allows the flight 40 to be connected to the shaft 30 firmly, whereby the flight 40 is not unexpectedly released from the shaft 30.

Embodiment 3

Embodiment 3 of the present disclosure will be described hereafter mainly in regard to the difference from Embodiments 1 and 2.

The flight unit 2 according to this embodiment is different from the flight unit 2 according to Embodiments 1 and 2 shown in FIGS. 7A to 7C and FIGS. 8A to 8C in that the protrusion 32 is catenoidal in the axis direction and slidably fitted in the hollow cylinder 42 of the flight 40.

Figure 9A:
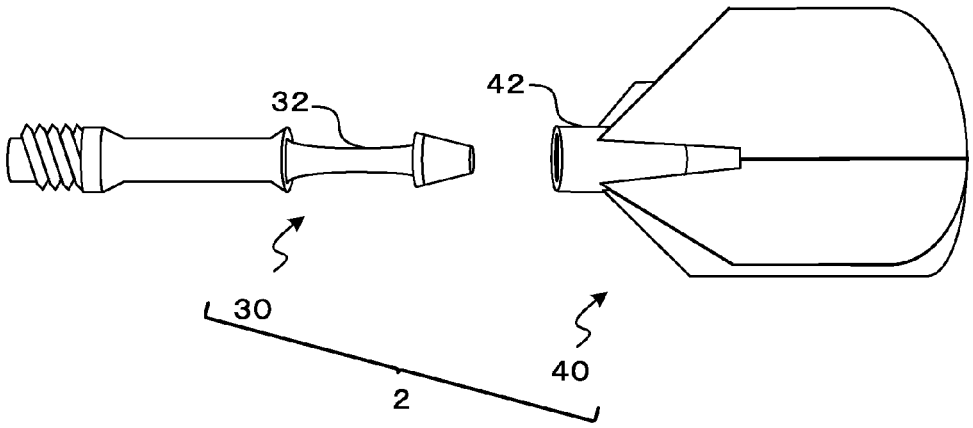
FIGS. 9A to 9C are illustrations showing the structure of the flight unit according to Embodiment 3.
Figure 9B:
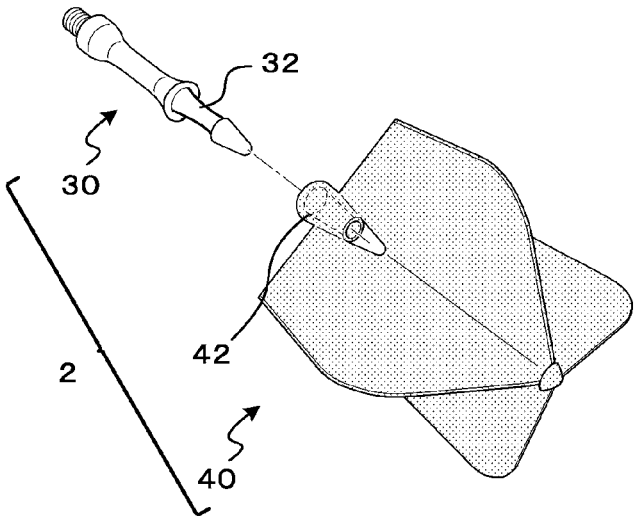
Figure 9C:
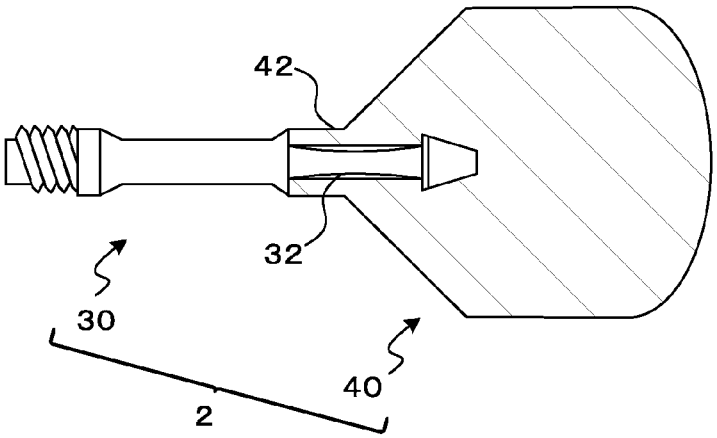

As shown in FIGS. 9A to 9C, the catenoidal protrusion 32 can make smaller the contact area between the inner wall surface of the hollow cylinder 42 and the outer wall surface of the protrusion 32, thereby causing a smaller frictional drag associated with the contact.

As shown in FIG. 9C, the hollow cylinder 42 slides on the catenoidal protrusion 32, whereby the flight 40 can rotate more smoothly with respect to the shaft 30.

Some embodiments of the present disclosure are described above. However, the present disclosure is not restricted to the above embodiments and drawings. Various embodiments and modifications are available to the present disclosure without departing from the broad sense of sprit and scope of the present disclosure.

For example, in the above-described embodiments, the flight 1 comprises four vines. The number of vines and their shape can be determined on an arbitrary basis.

Furthermore, in the above-described embodiment, the projection 36 is provided to the shaft 30 and the recess 46 is provided to the flight 40. Conversely, it is possible to provide a projection to the flight 40 and a recess fitting on the projection to the shaft 30. Furthermore, the projection, which has a cylindrical or truncated cone shape in the above-described embodiment, can have any other shape (for example, a hemisphere), and the recess can have any shape that is slidably fitted on the projection.

LEGEND

1 Dart
2 Flight unit
10 Point
20 Barrel
30 Shaft
31 Shaft body
32 Protrusion
33 First step
34 Flight connector
35 Second step
36 Projection
40 Flight
41 Vine
42 Hollow cylinder
43 Open cavity
44 Shaft-side end of hollow cylinder
45 Flight-side end of hollow cylinder
46 Recess The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A flight unit that is a part of a dart comprising a shaft and a flight, wherein the shaft has an axis direction and comprises a shaft body, a protrusion provided at one end of the shaft body, and a flight connector provided at the tip of the protrusion, the flight comprises a hollow cylinder in which the protrusion is slidably fitted, vines at the bases of which the hollow cylinder is provided, and an open cavity adjoining the hollow cylinder and in which the flight connector is slidably fitted, the open cavity is provided to the vines and comprises no exterior walls, the hollow cylinder is provided rotatably with respect to the protrusion of the shaft, wherein a projection projecting in the axis direction of the shaft where said projection is formed on one of the shaft and the flight, and a recess, in which the projection is fitted, said recess being formed in either the shaft or the flight.

2. The flight unit according to claim 1, wherein a first step is provided at the border between the shaft body and the protrusion, and a second step is provided at the border between the protrusion and the flight connector.

3. The flight unit according to claim 2, wherein a plane in which the first step lies and a plane in which the second step lies are parallel to each other and/or both perpendicular to the axis of the shaft.

4. The flight unit according to claim 1, wherein the protrusion is catenoidal in the axis direction of the shaft.

5. A dart comprising: flight unit according to claim 1;

a barrel functioning as a hold for the dart and a point that makes contact with the target.

* * * * *